United States Patent [19]

Carter et al.

[11] 3,960,576

[45] June 1, 1976

[54] SILICATE-BASED CORROSION INHIBITOR

[75] Inventors: David A. Carter, Warminster; Frederick G. Vogt, Philadelphia, both of Pa.

[73] Assignee: Betz Laboratories, Inc., Trevose, Pa.

[22] Filed: June 25, 1973

[21] Appl. No.: 372,878

[52] U.S. Cl. ..... 106/14; 21/2.7 A; 106/81; 106/177; 106/197 C; 252/181; 252/389 A

[51] Int. Cl.[2] ..... C09D 5/08; C02B 5/00; C23F 11/16

[58] Field of Search ..... 106/14, 81, 177, 197 C, 106/74, 75; 252/389 A, 175, 181; 21/2.7 A

[56] References Cited

UNITED STATES PATENTS

| | | | |
|---|---|---|---|
| 3,431,217 | 3/1969 | Hwa | 252/175 |
| 3,515,666 | 6/1970 | Bacon | 252/175 |
| 3,580,934 | 5/1971 | Murray | 252/389 |
| 3,630,790 | 12/1971 | Schmidt | 148/6.15 R |
| 3,630,938 | 12/1971 | Troscinski | 252/175 |
| 3,668,094 | 6/1972 | Hatch | 252/180 |
| 3,669,699 | 6/1972 | Doi et al. | 106/74 |
| 3,723,333 | 3/1973 | von Freyhold | 252/175 |
| 3,730,746 | 5/1973 | Boaz | 106/287 SE |
| 3,837,803 | 9/1974 | Carter | 252/181 |

*Primary Examiner*—Lorenzo B. Hayes
*Attorney, Agent, or Firm*—Alexander D. Ricci

[57] ABSTRACT

Inorganic-silicate-based compositions also comprised of an organic phosphonate and carboxy methyl cellulose are useful for inhibiting corrosion of metal surfaces, particularly steel, which are exposed to aqueous media. Inhibition is optimized when the surfaces are pretreated with a prefilming or passivating agent, then maintained with the above composition.

19 Claims, No Drawings

SILICATE-BASED CORROSION INHIBITOR

DESCRIPTION OF THE INVENTION

In the past, corrosion inhibitors for aqueous systems, such as once-through, open recirculating, and closed engine jacket cooling systems, have contained chromate and phosphates as active ingredients. Thus, these chemicals found their way into streams and waterways as part of the discharge from these aqueous systems. Such discharges are currently being legislatively regulated, and attempts have been underway to find acceptable corrosion inhibiting compositions which contain little or no chromates, phosphate or toxic materials, and which can either be easily degraded or readily removed.

The instant invention is one result of such a program, and provides a unique composition and process for its use in inhibiting corrosion of metal surfaces exposed to aqueous media. The inventors have discovered that a composition comprised of a water-soluble silicate, an organic phosphonate and a carboxy methyl cellulose will inhibit corrosion of the metal surfaces of aqueous systems, and is particularly effective when the metal is pretreated with a prefilming or passivating agent, or with the composition itself at a greater dosage before being maintained with it. While the composition is aimed at protecting steel surfaces primarily, it is also capable of preventing corrosion of copper and copper alloy surfaces when combined with a copper-inhibiting compound, such benzotriazole, mercaptobenzothiazole, mercaptobenzothiol, etc. It is also an effective corrosion inhibiting formulation for the other metals normally found in cooling systems such as aluminum, stainless steels, galvanized steel, solder and other metals and alloys.

The composition of this invention, in addition to possessing corrosion inhibition properties, is also an extremely effective agent for preventing the crystallization and deposition of dissolved solids which tend to precipitate on hot heat transfer surfaces, e.g. calcium carbonate, magnesium silicate, etc. In the case of calcium carbonate, the crystallization inhibitors are needed at a pH greater than the pH of saturation for $CaCo_3$. Where the pH is less than the saturation pH for calcium carbonate, these anti crystallization inhibitors are not necessary. However, at the latter pH level, corrosion becomes a major problem, and one must employ a corrosion inhibitor. Above the pH of saturation, it is necessary to prevent calcium carbonate deposition in addition to corrosion inhibition.

The effective pH range for our composition is from about 4 to about 11, preferably 7 to 9. Calcium concentrations quite high can be tolerated without loss of corrosion inhibition or scale prevention, e.e. from about 0 ppm to about 4,000 ppm calcium as calcium carbonate. Consequently, the composition of this invention can be used to both prevent scale and inhibit corrosion. It has also been found that it is an effective dispersant of solid particulate matter, which may be present in the aqueous system and also cause undesirable deposition: e.g. iron, clays and silts.

Acceptable metal corrosion inhibition and scale prevention is achieved when an aqueous system is maintained by the above composition in the following amounts: 5 to 300 parts by weight of a water-soluble silicate as $Si\ O_2$, per million parts by weight of water, preferably 10 ppm to 50 ppm; 0.1 ppm to 100 ppm of an organic phosphonate as $PO_3$, preferably 1 ppm to 100 ppm; 1 ppm to 150 ppm of a carboxy methyl cellulose, preferably 10 to 50 ppm; and 0 to 20 ppm of a copper inhibitor, preferably 0.1 to 20 ppm.

In the preferred use of the composition of this invention, the metal surfaces of an aqueous system to be protected are first pre-treated with a larger dosage than the above maintenance levels for a time preferably greater than about four hours. It should be understood that the exact time of pretreatment is not critical, since any amount of pretreatment will enhance the inhibiting effect of the maintenance dosage. Pretreatment levels of the instant composition are generally from about twice to about 5 times the above maintenance levels. If another prefilming agent is used for pretreatment, the amount will depend upon the exact composition. Any corrosion inhibiting compound, where used at levels exceeding normal maintenance, will suffice as the pretreatment.

The $Si\ O_2$ portion of the instant composition may be provided by any source of water-soluble silicate, such as dry or solubilized alkaline silicates where the ratio of the alkaline oxide to $Si\ O_2$ ranges from about 1:1 to about 1:3.5. If the makeup water of the system to be treated already contains solubilized silicates, this amount may be included in determining the treatment level to be used.

Generally, any organic phosphonate can be used in the composition of this invention. A good source is an organo-phosphonic acid, having a carbon to phosphorus bond and the following general structure,

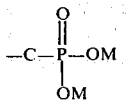

Such compounds are generally found in one of the three following categories:

1. Compounds with the structure,

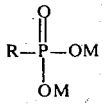

where R is a lower alkyl or substituted alkyl group with from 1 to 6 carbons, or an aryl or substituted aryl group; and M is a water-soluble cation, such as sodium, potassium, ammonium, etc., or hydrogen;

2. Compounds with the structure,

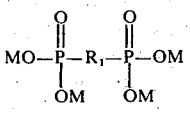

where $R_1$ is an alkylene or substituted alkylene group having from 1 to 12 carbons, and M as defined in (1) above;

3. Compounds with the structure,

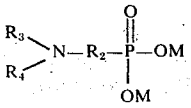

where $R_2$ is a lower alkylene or substituted alkylene group with 1 to 4 carbons; $R_3$ is $[R_2—PO_3M_2]$, H, OH, an amino - or substituted aminogroup, an alkyl or substituted alkyl group with 1 to 6 carbons, or an aryl or substituted aryl radical; $R_4$ is $R_3$ or the group with the formula,

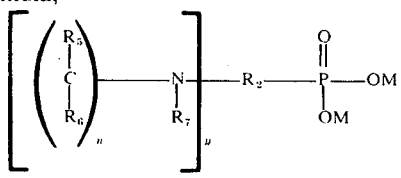

where $R_5$ and $R_6$ can be hydrogen, a lower alkyl or substituted alkyl group of 1 to 6 carbons; an aryl or substituted aryl group; $R_7$ is $R_5$, $R_6$ or the group $R_2$—$PO_3M_2$ ($R_2$ as defined above); $n$=1 to 15; $y$=1 to 14; M is as earlier defined.

The presently preferred phosphonate is 1-hydroxyethylidene, 1,1-diphosphonic acid, available commercially as Dequest 2010, from the Monsanto Chemical Company. This compound possesses the structure of those under category (2) above. Another preferred phosphonate is nitrilo-tris-[methylene phosphonic acid] or Dequest 2000, representative of category (3) above.

Typical useful silicate sources are RU Silicate (sodium silicate, $Na_2O:SiO_2$=1:2.4, 30% solution) and Kasil 6 (potassium silicate, $K_2O$: $SiO_2$=1:2.1, 38% solution), both available from the Philadelphia Quartz Company.

A variety of carboxy methyl celluloses are suitable for use with the composition of this invention. A preferred type is CMC-7LT, available from Hercules Chemical Incorporated.

In order to determine the effectiveness of the corrosion inhibitors of this invention, two types of tests were conducted, spinner tests and recirculator tests.

Spinner Tests

In this test, low carbon steel coupons are cleaned, weighed and exposed on a rotating holder to simulated cooling water containing the treatment in a 17 or 22 liter glass jar. The temperature is usually maintained at 120° F and the pH is manually controlled. The coupons are removed after the first day and after 3 to 4 days and the weight loss due to corrosion is determined, as well as the extent and nature of any deposits and the amount of pitting. The corrosion rate is computed in mils per year (mpy). When the coupons are pretreated, this step occurs right after the initial weighing.

An example composition was prepared with the following formulation:

90 ppm RU Silicate (19 ppm $SiO_2$)
16.6 ppm Dequest 2010 (10 ppm as $PO_3$)
20 ppm carboxy methyl cellulose (CMC-7LT)
3 ppm benzotriazole The following results were obtained for coupons pretreated with 800 ppm of a composition containing 80% sodium hexametaphosphate and 20% zinc sulfate monohydrate for 6 hours. Then the coupons were maintained with the above silicate composition for 5 days. Hardness and pH values are listed. The treated water also contained 119.4 ppm chloride, 105.5 ppm sulfate and 0.2 ppm copper. Approximate flow rate was 1.3 feet per second, at a temperature of 120° F with continuous aeration.

| Silicate ($SiO_2$) | Dequest 2010 | CMC-7LT | Benzotriazole | pH | Hardness (ppm) Ca++Mg++ (As $CaCO_3$) | | AVG (Differential Corrosion MPY Rate - Steel) |
|---|---|---|---|---|---|---|---|
| 19 ppm | 16.6 ppm | 20 ppm | 3 ppm | 8.5 | 170 | 110 | 1 |
| 19 | 36.6 | 20 | 3 | 7.5 | 170 | 110 | 7.5 |
| 19 | 16.6 | 20 | 3 | 9 | 170 | 110 | 9 |
| 19 | 16.6 | 20 | 3 | 8.5 | 340 | 110 | 8 |
| 19 | 1.6 | 20 | 3 | 8.5 | 170 | 220 | 7.5 |

An average untreated low carbon steel coupon in the same test will corrode at a rate between 100 to 120 mpy. The above results indicate the effectiveness of the instant composition and its relative independence of changes in the hardness of the treated water and the pH.

At the same treatment level, low carbon steel coupons, without pretreatment, had an average corrosion rate of 14 mpy, and high carbon steel coupons had an average rate of 15 mpy. While this indicates good corrosion inhibition even without pretreatment, it can be seen that pretreatment enhances the effect.

Spinner tests were conducted using Dequest 2,000 as the organic phosphonate and the same pretreatment as Table 1 tests; the formulations used are listed separately:

Table 2 (pH=8.5)

| Silicate (as $SiO_2$) | CMC-7LT | Dequest 2000 (as $PO_3$) | Avg Mpy (Differential Corrosion Rate - Steel) |
|---|---|---|---|
| 38 ppm | 20 ppm | 9.5 ppm | 16 |
| 19 | 20 | 9.5 | 12 |
| 19 | 10 | 9.5 | 14 |
| 19 | 10 | 4.8 | 19 |

Recirculator Tests

This test better reproduces the actual industrial conditions that a corrosion inhibitor must withstand if it is to be effective. Corrosion test coupons are suspended from holders held in a chamber through which simulated cooling water is pumped past the metal surface. In addition, the recirculating system has both constant makeup of new treated water and constant blowdown. A heat transfer tube is also present in the system, allowing a study of the effect of a heat transfer surface on corrosion and scaling.

EXAMPLE 1

Low Carbon steel coupons were pretreated for 6 hours with 800 ppm of a passivating agent consisting of 80% sodium hexamethaphosphate and 20% zinc sulfate. The coupons were then placed in a recirculating system, the water of which had a pH of 8.5 and a total hardness of simulated cooling water; i.e., 170 Ca++ and 110 Mg++. The coupons were treated for 7 days at a linear flow rate of 2 ft./sec. The corrosion inhibitor formulation employed was:

19 ppm — Silicate as ($SiO_2$)
10 ppm — Dequest 2010 (as $PO_3$)
15 ppm — C M C — 7 L T
3 ppm — benzotriazole The average corrosion rate was a low 1 mpy on steel and less than 1 mpy on copper. No corrosion or pitting was observed.

The hardness of the water was increased to about 1,000 ppm as calcium carbonate, and the pH was reduced to 7.5. At this level, the saturation pH for calcium carbonate is 6.5. This produced conditions normally conducive to deposition or scale formation. However, with the above composition present, no settling out was observed over a 5 day period. This indicates that the above composition functions equally well as a corrosion inhibitor or a scale preventative.

EXAMPLE II

Same as Example 1 except that the coupons were not pretreated before maintenance and had a corrosion rate of 14 mpy in a five-day test.

EXAMPLE III

Same as Example 1 except that coupons were pretreated with the silicate composition of Example 1 at triple strength. Over two days time, the corrosion rate was about 5 mpy on steel.

As can be seen, the corrosion inhibitors of this invention function best when the subject metal surfaces are pretreated. Generally, any compound or composition which is known to protect metal surfaces from corrosion can be used as the pretreatment. Even if the pretreating chemical contains phosphates or chromates, little of these chemicals will be discharged in effluent, since in practical applications, pretreatment involves one step exposure of the metal to the pretreating chemical, followed by extended periods of maintenance with the nonphosphate, non-chromate composition of this invention. Thus, over a long period of time, the only possible discharge of phosphate-chromate will be the one-batch pretreatment. The advantage in using the composition of this invention as the pretreatment would, of course, be the absence of any undesirable discharge at all. This type of pretreatment would, obviously, have to be used in areas where zero discharge of chromate or phosphate is the requirement.

Having thus described the invention, what is claimed is:

1. A composition of matter which is useful for inhibiting corrosion of the metal surfaces exposed to an aqueous system and preventing the deposition of scale thereon, consisting essentially of in parts by weight: 5 to 1,500 parts of a water-soluble alkaline oxide silicate having a ratio of $SiO_2$ to the alkaline oxide of from 1 to 3.5; 0.1 to 500 parts of an organic phosphonate as $PO_3$ wherein the organo-phosphonate has a carbon to phosphorus bond as in the formula

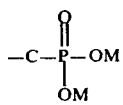

where M is a water soluble cation or hydrogen; and 1 to 750 parts of a carboxy methyl cellulose.

2. The composition of claim 1, further comprising up to 100 parts of a chemical agent which inhibits the corrosion of copper metal surfaces exposed to an aqueous system.

3. The composition of claim 1, where said silicate levels are from 5 to 300 parts, the phosphonate levels are from 0.1 to 100 parts, and the carboxy methyl cellulose levels are from 1 to 150 parts.

4. The composition of claim 1, where the organic phosphonate is
selected from the group of phosphonates having the following formula:

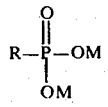

(1)

where R is a lower alkyl or substituted alkyl group with from 1 to 6 carbons, or an aryl or substituted aryl group; and M is a water-soluble cation or hydrogen

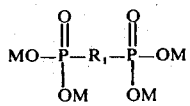

(2)

where $R_1$ is an alkylene or substituted alkylene group having from 1 to 12 carbons, and M is as defined in (1);

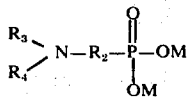

(3)

where $R_2$ is a lower alkylene or substituted alkylene group with 1 to 4 carbons; $R_3$ is, H, OH, an amino- or substituted amino- group, an alkyl or substituted alkyl group with 1 to 6 carbons, or an aryl or substituted aryl radical; $R_4$ is $R_3$ or the group with the formula

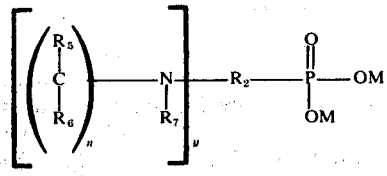

where $R_5$ and $R_6$ can be hydrogen, a lower alkyl or substituted alkyl group of 1 to 6 carbons; an aryl or substituted aryl group; $R_7$ is $R_5$, $R_6$ or the group $R_2$ — $PO_3$ $M_2$ where M is as defined in (1) and $R_2$ is as defined in (3); n = 1 to 15; y = 1 to 14; and M is as defined in (1).

5. The composition of claim 4, where the organophosphonic acid is 1-hydroxyethylidene, 1,1-diphosphonic acid.

6. The composition of claim 4, where the organophosphonic acid is nitrilo-tris-.

7. The composition according to claim 4 wherein the silicate is selected from the group consisting essentially of sodium silicate and potassium silicate.

8. A process of inhibiting the corrosion of the metal surfaces exposed to an aqueous system and preventing deposition of scale thereon, which comprises adding to said system the composition of claim 3, where the parts by weight of said composition are per million parts of the water in said aqueous system.

9. A process of inhibiting the corrosion of the metal surfaces exposed to an aqueous system and preventing deposition of scale thereon, which comprises adding to said system the composition of claim 4, where the parts by weight of said composition are per million parts of the water in said aqueous system.

10. A process of inhibiting the corrosion of the metal surfaces exposed to an aqueous system and preventing deposition of scale thereon, which comprises adding to said system the composition of claim 5, where the parts by weight of said composition are per million parts of the water in said aqueous system.

11. A process of inhibiting the corrosion of the metal surfaces exposed to an aqueous system and preventing deposition of scale thereon, which comprises adding to said system the composition of claim 7, where the parts by weight of said composition are per million parts of the water in said aqueous system.

12. The process of claim 8, which further comprises an initial step of pretreating said metal surfaces with a composition comprised of 10 parts to 1,500 parts of water-soluble silicate, 0.2 to 500 parts of an organic phosphonate wherein the organic phosphonate has a carbon to phosphorus bond as in the formula

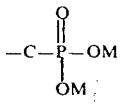

where M is a water soluble cation or hydrogen, 2 to 750 parts of a carboxy methyl cellulose.

13. The process of claim 12, where the organic phosphonate is selected from the group of phosphonates having the following formula:

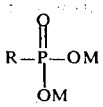

(1)

where R is a lower alkyl or substituted alkyl group with from 1 to 6 carbons, or an aryl or substituted aryl group; and M is a water-soluble cation; or hydrogen

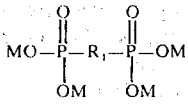

(2)

where $R_1$ is an alkylene or substituted alkylene group having from 1 to 12 carbons, and M is as defined in (1);

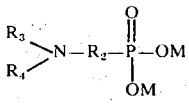

(3)

where $R_2$ is a lower alkylene or substituted alkylene group with 1 to 4 carbons; $R_3$ is, H, OH, an amino- or substituted amino- group, an alkyl or substituted alkyl group with 1 to 6 carbons, or an aryl or substituted aryl radical; $R_4$ is $R_3$ or the group with the formula

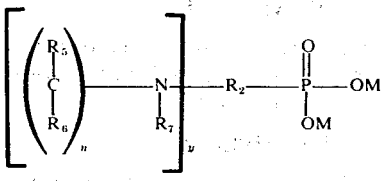

where $R_5$ and $R_6$ can be hydrogen, a lower alkyl or substituted alkyl group of 1 to 6 carbons; an aryl or substituted aryl group; $R_7$ is $R_5$, $R_6$ or the group $R_2$ — $PO_3$ $M_2$ where M is as defined in (1) and $R_2$ is as defined in (3); $n = 1$ to 15; $y = 1$ to 14; and M is as defined in (1).

14. The process of claim 13, where said organo-phosphonic acid is 1-hydroxyethylidene, 1,1-diphosphonic acid.

15. A process according to claim 8 wherein the aqueous medium is the aqueous medium of a cooling water system.

16. A process according to claim 9 wherein the aqueous medium is the aqueous medium of a cooling water system.

17. A process according to claim 10 wherein the aqueous medium is the aqueous medium of a cooling water system.

18. A process according to claim 13 wherein the organo phosphonic acid is nitrilo-tris-.

19. A process according to claim 18 wherein the aqueous medium is the aqueous medium of a cooling water system.

* * * * *